United States Patent [19]

Shomura et al.

[11] Patent Number: 4,605,328

[45] Date of Patent: Aug. 12, 1986

[54] POLYCHROME PRINTING PLATEN OF A PRINTER

[75] Inventors: Eiichi Shomura; Taiji Goto, both of Tokyo, Japan

[73] Assignee: Janome Sewing Machine Co., Ltd., Tokyo, Japan

[21] Appl. No.: 612,442

[22] Filed: May 21, 1984

[30] Foreign Application Priority Data

Jun. 1, 1983 [JP] Japan ..... 58-81849[U]

[51] Int. Cl.[4] ..... B41J 11/04; B41J 11/057

[52] U.S. Cl. ..... 400/662; 400/124; 400/470; 400/657

[58] Field of Search ..... 400/660.3, 657, 662, 400/470, 144.2, 124; 101/378, 382 MV; 209/219, 220

[56] References Cited

U.S. PATENT DOCUMENTS

| | | | |
|---|---|---|---|
| 618,252 | 1/1899 | Meyrueis | 101/378 X |
| 1,357,341 | 11/1920 | Novotny | 101/378 |
| 1,377,506 | 5/1921 | Novotny | 101/378 |
| 2,346,163 | 4/1944 | Hiles | 400/662 X |
| 3,039,389 | 6/1962 | Meese et al. | 101/382 MV |
| 3,509,819 | 5/1970 | Conole | 101/378 |
| 3,919,937 | 11/1975 | Kostal | 101/378 |
| 4,386,861 | 6/1983 | Kurihara et al. | 400/470 X |

FOREIGN PATENT DOCUMENTS

| | | | |
|---|---|---|---|
| 33972 | 4/1981 | Japan | 400/144.2 |
| 98378 | 6/1982 | Japan | 400/657 |
| 15409 | of 1912 | United Kingdom | 400/470 |

OTHER PUBLICATIONS

IBM Tech. Disc. Bulletin, "Color Wheel with Inked Platens", Humphreys, vol. 25, No. 4, Sep. 1982, p. 2193.

*Primary Examiner*—Edgar S. Burr
*Assistant Examiner*—James R. McDaniel
*Attorney, Agent, or Firm*—Michael J. Striker

[57] ABSTRACT

A polychrome printing platen of a printer having a platen shaft comprises an axially elongated platen body rotatably mounted on the platen shaft and having a plurality of grooves formed therein to extend in the axial direction and spaced from each other in the circumferential direction, and a plurality of permanent magnets each arranged in each of the grooves. A plurality of axially elongated elements having inks of different colors impregnated therein are attached to the platen body. Each ink impregnated element has an upper face and a lower face and has a magnetizable plate secured to the lower face thereof. All ink impregnated elements are detachably attached to the platen body by the permanent magnets which attract the magnetizable plates.

4 Claims, 3 Drawing Figures

POLYCHROME PRINTING PLATEN OF A PRINTER

BACKGROUND OF THE INVENTION

Field of the Invention

This invention relates to a polychrome printing platen of a printer, and more particularly to a platen of a wire dot type printer, in which at least two bodies containing different inks are provided on a platen body.

There have been conventionally proposed polychrome printing platens for wire dot type printer. The platens have been often exchanged due to consumption of inks by many printings. Exchanging was not easy, and since a partial exchanging was not possible, it was wasteful, and uneconomical waste was incurred to users.

SUMMARY OF THE INVENTION

An object of the present invention is to remove the above mentioned disadvantages of the prior art. A platen body according to the present invention is provided with at least two elements containing respectively different colour inks and detachably-attached to the platen body by means of attaching means, whereby an entire body of the platen is not exchanged if a new colour ink is necessary, but only a portion of the platen body using up the ink is exchanged, to thereby save futile expense to the users.

Another object of the invention is to provide attaching means by burying magnets in the platen body, while securing magnetic bodies to the ink containing elements. The attaching mechanism is easy in handling and simple in structure.

DETAILED DESCRIPTION OF THE PREFERRED EMBODIMENT

Figure 1:
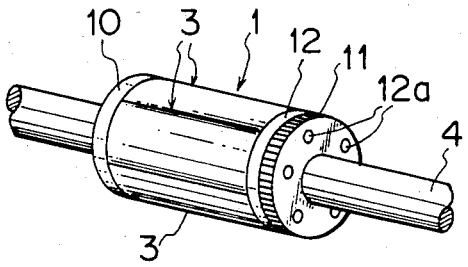
FIG. 1 is a perspective view showing a polychrome printing platen mounted on a platen shaft.
Figure 2:
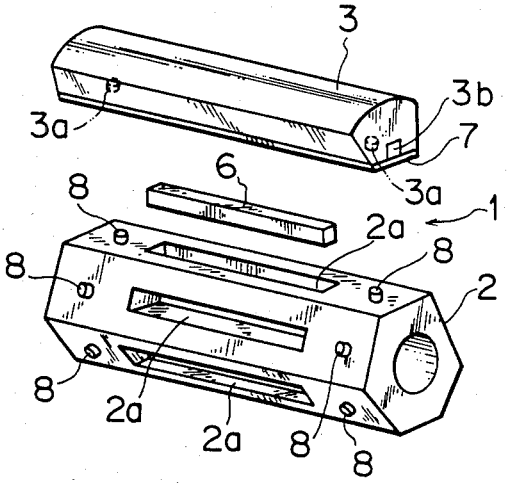
FIG. 2 is an exploded perspective view of the polychrome printing platen.

The present invention will be discussed in reference to an embodiment shown in the accompanied drawings. A polychrome printing platen 1 of a printer according to the invention comprises a platen body 2 and a plurality of colour ink impregnating bodies 3, and it is rotatably mounted on a platen shaft 4 secured to a machine frame (not shown). The platen 2 is, for example, hexagonal in cross section, and a concave or recess 2*a* defined in each face portion thereof is fixedly attached with magnets 6 by means of attaching means in such a manner that the magnet does not protrude with its top from an upper surface of the concave 2*a*.

Figure 3:
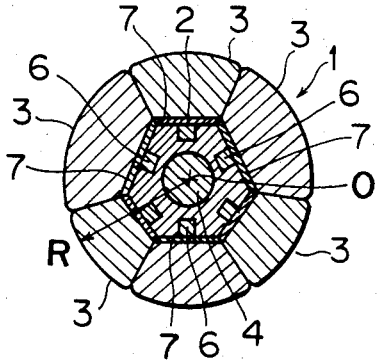
FIG. 3 is a vertical cross sectional view of the polychrome printing platen.

The color ink impregnating body 3 is, as shown in FIG. 3, defined by lines combining a circumference of radius R, a center 0 of the shaft 4 and an angle included between the face portions of the platen 2, and is positioned in parallel to the axis of the platen shaft 4.

The color ink impregnating bodies 3 are made of sintered metals or porous resins containing, for example, black, red, blue, yellow, etc. and provided at bottoms with metal plates 7 which are one example of the magnetic bodies.

Each ink containing body 3 having the metal plate 7 is formed at the bottom wall with a pair of holes 3*a* for supporting a pair of pins 8 implanted in each of the faces of the platen 2, and, on the other hand, it is formed with a cutout 3*b* at its one end face.

The platen 1 mounted on the shaft 4 is, as shown in FIG. 1, secured at its both ends with side plates 10, 12 mounted on the shaft 4, and the side plate 12 is formed integrally with a gear 11. The side plate 12 is formed with a plurality of holes 12*a* at positions corresponding to the cutouts 3*b* of the ink containing bodies 3. The outer circumferences of the side plates 10, 12 are slightly greater than the outer circumference of the ink containing body 3. The body 3 has a length which is slightly shorter than the distance between the side plates 10 and 12, so that when a gear (not shown) engaging with the gear 11 is rotated, the printing mechanism (not shown) selects a desired one of the ink containing bodies 3.

The present device is composed as mentioned above, and its actuation will be referred to in the following:

The color ink impregnating bodies 3 are mounted on the platen 2 by fitting the pins 8 of the platen into the holes 3*a* of the bodies 3. Then, the metal plates 7 of the bodies 3 are drawn to the magnets 6 mounted in the concaves 2*a* formed in the platen 2, so that the bodies are secured to the platen 2.

Any one of the ink containing bodies 3 is exchanged by inserting a bar-like means (not shown) into the corresponding cutout 3*b* of the ink containing body 3 through the corresponding hole 12*a* of the side plate 12 and lifting up the body 3 against magnetic force of the magnet 6, and taking it out from the platen 2.

The attaching mechanism of the body 3 to the platen 2 is not limited to the magnet 6, and means are also sufficient, that include plate springs provided at the both ends of the body 3, and the body 3 is put under pressure between the side plates 10 and 12 to be secured to the platen 2. With respect to a size of the color ink containing body, all of them may be equal, or ones to be frequently used may be made larger.

The present device is designed and operated as mentioned above, and it has merits that the platen body is detachably provided with at least two bodies containing respectively different color inks by means of the attaching means so that the platen itself is not exchanged but only a partial body using up the ink is exchanged, to thereby save the expense to the users.

In addition, the magnet buried in the platen attracts the magnetic body held in the ink containing body, so that it is possible to provide the attaching mechanism of simple structure and easy handling.

It will be understood that each of the elements described above, or two or more together, may also find a useful application in other types of printing platens for printers differing from the types described above.

While the invention has been illustrated and described as embodied in a polychrome printing platen of a printer, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A polychrome printing platen of a printer having a platen shaft, comprising an axially elongated platen core of polygonal cross-section to form a plurality of planar support faces extending in the direction of elongation of said core, said core being rotatably mounted on said platen shaft and having a plurality of grooves each formed in a respective support face and extended in the direction of elongation of said core, said grooves being spaced from each other in a circumferential direction of said core; a plurality of permanent magnets each mounted in one of said grooves and each having an upper face coplanar with a respective support face; a plurality of axially elongated elements having inks of different colors impregnated therein, each of said ink impregnated elements having an upper face and a lower face and having a magnetisable plate secured to the lower face thereof, said ink impregnated elements being detachably attached to and retained on said platen core by said permanent magnets which attract said magnetisable plates, and by means preventing each of said ink impregnated elements from being displaced along said support face, whereby said elements are individually and optionally interchangeable on said core.

2. A printing platen as defined in claim 1, wherein said preventing means include a plurality of positioning pins implanted in said platen core at said support faces and a plurality of holes formed at the lower faces of said ink impregnated elements, said positioning pins being inserted into said holes of said ink impregnated elements to precisely position each of said ink impregnated elements with respect to said platen core when the former is attached to the latter.

3. A printing platen as defined in claim 2, wherein each of said ink impregnated elements has opposite end faces in the direction of elongation thereof, one of said opposite end faces having a cutout formed therein, which is accessible to detach each of said ink impregnated elements from said platen core.

4. A printing platen as defined in claim 3, wherein at least one of said ink impregnated elements is wider than the others.

* * * * *